US005901953A

United States Patent [19]

Brown, Sr. et al.

[11] Patent Number: 5,901,953

[45] Date of Patent: May 11, 1999

[54] DIVERTER APPARATUS AND METHOD FOR SHEETS OR ENVELOPES

[75] Inventors: Keith A. Brown, Sr., Port St. Lucie, Fla.; Gregory T. Lucas, Huntington Beach, Calif.; Neal J. Middelberg, Apex, N.C.; Daniel C. Park, West Linn, Oreg.

[73] Assignee: Bell & Howell Mail Processing Systems Company, Durham, N.C.

[21] Appl. No.: 08/734,718

[22] Filed: Oct. 21, 1996

[51] Int. Cl.[6] ..... B65H 29/62

[52] U.S. Cl. ..... 271/184; 271/271; 271/2; 414/790.3

[58] Field of Search ..... 271/9.02, 184, 271/185, 186, 198, 271; 209/547; 414/790.3

[56] References Cited

U.S. PATENT DOCUMENTS

| | | | |
|---|---|---|---|
| 4,318,484 | 3/1982 | Stiernspetz | 209/534 |
| 5,000,657 | 3/1991 | Gunther, Jr. | 414/790.3 |
| 5,103,982 | 4/1992 | Walter et al. | 209/547 |
| 5,141,216 | 8/1992 | Ballestrazzi et al. | 271/10 |
| 5,340,099 | 8/1994 | Romanenko et al. | 271/303 |

*Primary Examiner*—William E. Terrell
*Assistant Examiner*—Patrick Mackey
*Attorney, Agent, or Firm*—Jenkins & Wilson, P.A.

[57] ABSTRACT

A diverter apparatus and method are provided for high-speed media processing for diverting media such as envelopes or envelope inserts including folded sheets of paper from a conveying path and in a divert direction substantially opposite to the direction of the conveying path. In the preferred embodiment, the diverter apparatus includes a rotation member such as a belt which can be moved in opposite directions and which includes a plurality of push members thereon for engaging and conveying media. A closed-loop servomotor or a step motor can be utilized to drive the belt. In an advance mode, the belt rotates so that at least one push member causes media to be conveyed in the direction of the conveying path. In a divert mode, rotation of the belt is reversed so that at least one push member diverts and conveys media in a divert direction opposite to the direction of the conveying path. Diverted media is advanced to a divert chute through which it can pass to a collecting bin.

13 Claims, 2 Drawing Sheets

DIVERTER APPARATUS AND METHOD FOR SHEETS OR ENVELOPES

TECHNICAL FIELD

The present invention relates generally to high-speed media processing apparatuses and methods. More particularly, the present invention relates to an apparatus and method for diverting media, such as envelopes or envelope inserts including, for example, folded sheets of paper, from a conveying path to an opposite divert direction using the same mechanism that is used to convey the media along the conveying path.

RELATED ART

A variety of high-speed media processing apparatuses and methods exist in the art for processing media such as, for example, mail media comprising envelopes and envelope inserts which typically include folded sheets of paper. Such media are usually conveyed in a conveying path wherein individual media items or subsets of media items are conveyed or transported in seriatim fashion. As will be apparent to those of skill in the art of high-speed media processing, a need commonly exists for selectively diverting some of the media items from the conveying path during processing. When a high-speed media processing apparatus is processing mail-related items, such as high-volume business mail, along a conveying path, it is advantageous to selectively divert media from the conveying path at a location subsequent to a location where the media are folded and prior to a location where the media are inserted into envelopes.

In the past, media conveyed in a conveying path during high-speed media processing have been diverted therefrom by using a solenoid-driven ramp or gate to selectively direct the media items above or below the conveying path. This divert method requires two electronically controlled mechanisms which are the divert solenoid and the mechanism for transporting the media in the conveying path. This prior art method of diverting media in high-speed media processing can therefore be said to be "in-line" with the conveying path of the high-speed media processing apparatus. It is a requirement of this prior art method therefore that an additional component, i.e. a solenoid, be utilized and that the machine processing the media be long enough to accommodate the divert gate. The use of the divert gate also has the potential of slowing down the overall system performance due to the activation time required to open and close the gate.

Despite the existence of prior art apparatuses and methods for diverting media from a conveying path in high-speed media processing, there exists much room for improvement in the art, particularly for a diverter apparatus and method for diverting and conveying media from a conveying path to and along an opposite divert direction using the same mechanism that is used to convey media along the conveying path.

DISCLOSURE OF THE INVENTION

The present invention provides a diverter apparatus and method for high-speed media processing for diverting media conveyed along a conveying path and conveying the diverted media in an opposite divert direction. The diverter apparatus comprises divert means for selectively diverting media from a conveying path and conveying the media in a divert direction opposite to the direction of the conveying path. The divert means can also be used to convey media along the conveying path when the divert action does not occur. The diverter apparatus includes means for collecting media diverted and conveyed by the divert means wherein such means for collecting preferably comprises a divert chute and a collecting bin.

The divert means comprises a rotation member, which can be a belt, which is rotatably moveable by a motor and gears or pulleys associated therewith. A plurality of push members, which can be referred to as "push-pins" or "push lugs", are spacedly positioned on the belt and adapted for engaging and conveying media encountered by the push members. A step motor or closed-loop servomotor can be utilized to drive the belt, and the belt can be selectively reversed from rotation in the conveying direction such that the belt rotates in a substantially opposite, divert direction and at least one of the push members on the belt diverts and conveys media from the conveying direction in the opposite divert direction wherein the diverted media are passed to the divert chute and pass therethrough to the collecting bin.

It is therefore an object of the present invention to provide a novel diverter apparatus and method for diverting media from a conveying path and conveying the diverted media in a divert direction.

It is another an object of the present invention to provide a novel diverter apparatus and method for diverting media from a conveying path and conveying the diverted media in a divert direction utilizing the same mechanism that is utilized for conveying media along the conveying direction.

It is yet another object of the present invention to provide a diverter apparatus and method for diverting and conveying media from a conveying path in high-speed media processing in an opposite divert direction instead of diverting the media in an "in-line" manner as in prior art diverting apparatuses and methods.

It is a further object of the present invention to provide a diverter apparatus and method for diverting and conveying media from a conveying path in high-speed media processing wherein minimal additional space is required within the high-speed media processing apparatus and where the need for other electronic devices and hardware to divert the media is eliminated.

Some of the objects of the invention having been stated hereinabove, other objects will become evident as the description proceeds, when taken in connection with the accompanying drawings as best described hereinbelow.

BEST MODE FOR CARRYING OUT THE INVENTION

Figure 1:
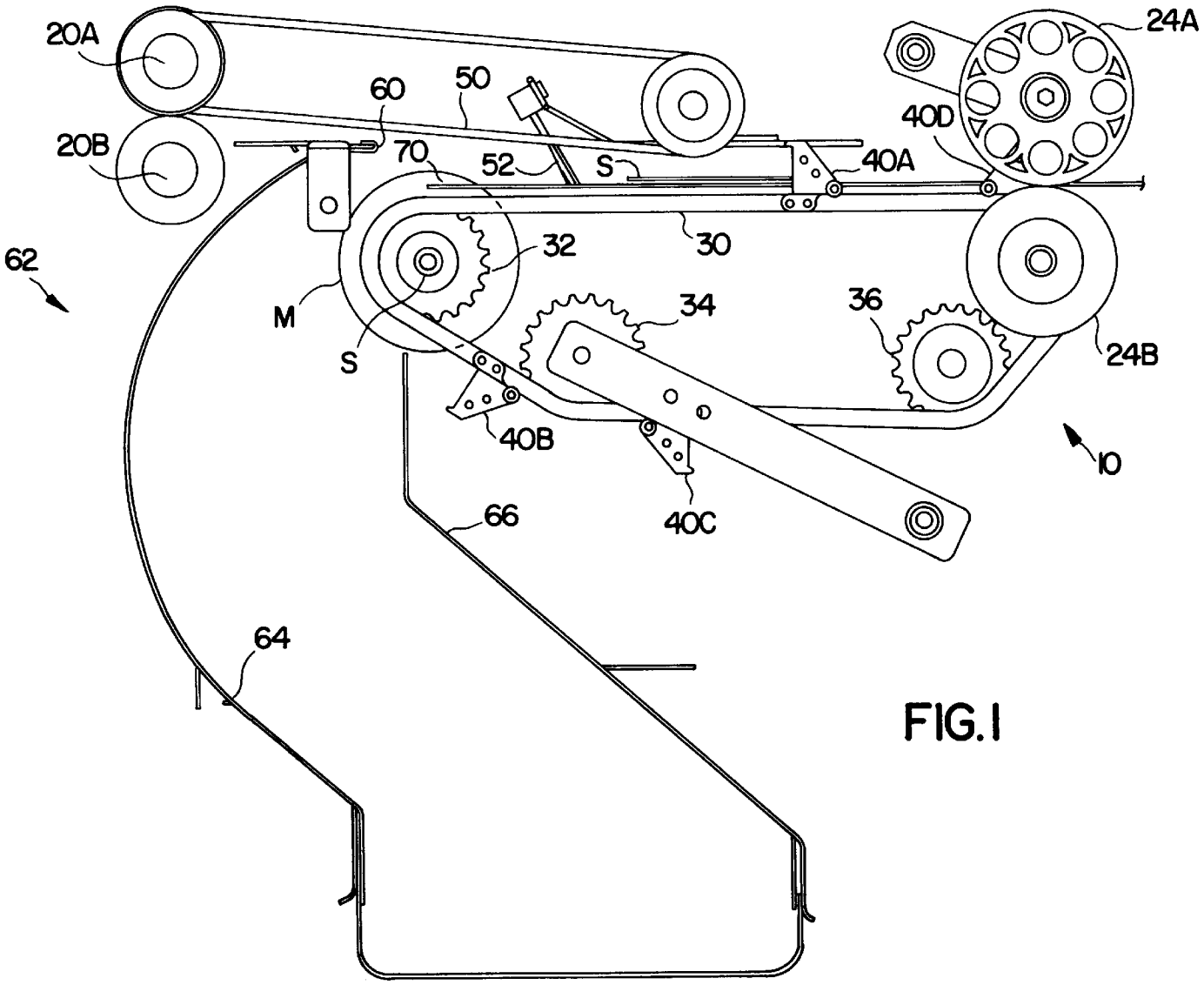
FIG. 1 of the drawings is a side view of a preferred embodiment of the diverter apparatus of the present invention utilized in high-speed media processing.
Figure 2:
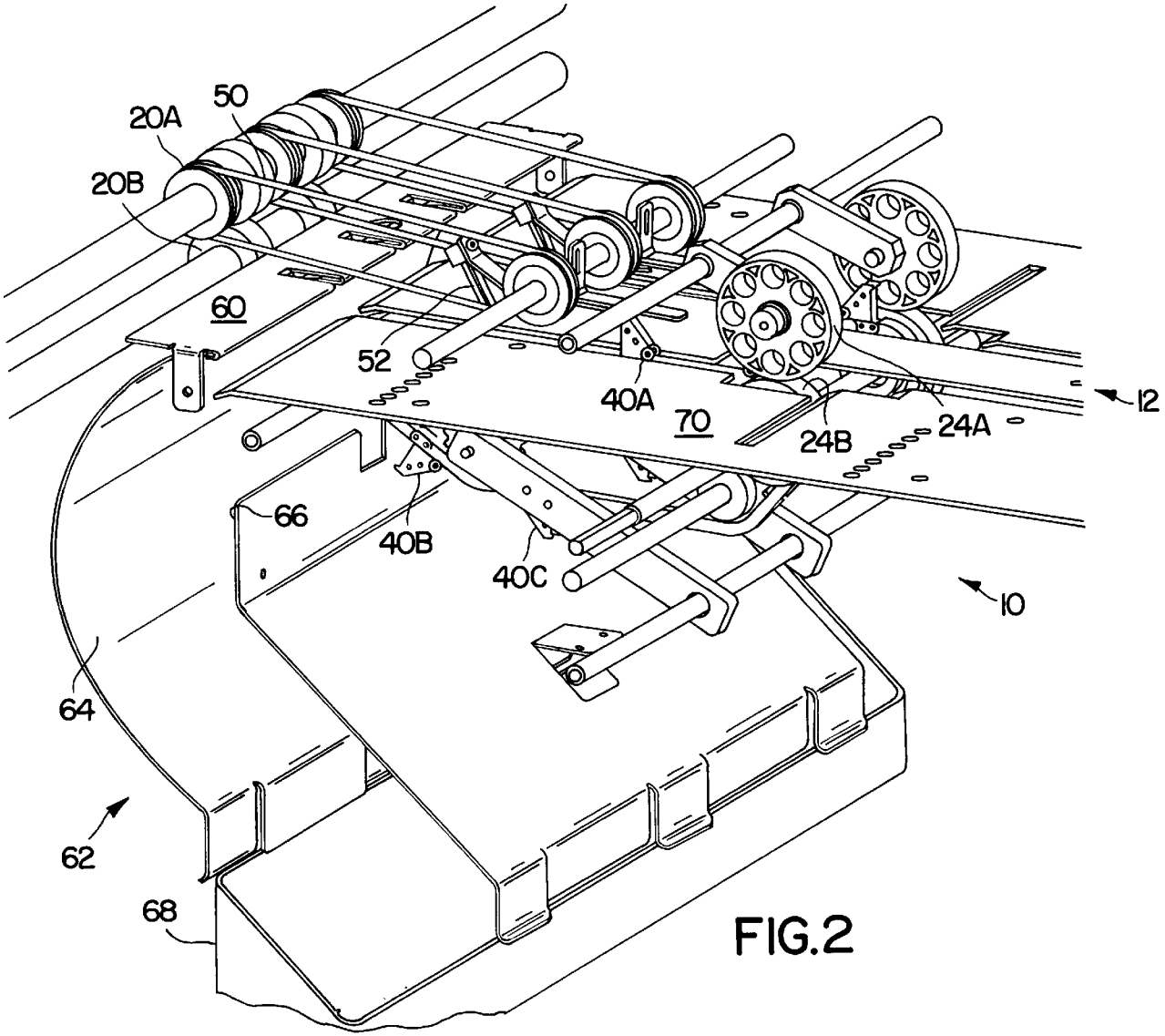
FIG. 2 of the drawings is a perspective view of the diverter apparatus shown in FIG. 1.

A preferred embodiment of a diverter apparatus according to this invention is shown in FIG. 1 and 2 and actually comprises two diverter apparatuses generally designated 10 and 12, best illustrated in FIG. 2, which can work in a parallel manner synchronously with one another. For ease of explanation, diverter apparatus 10 will be described herein since diverter apparatuses 10 and 12 are preferably identical.

Diverter apparatus 10 is particularly suitable for use in high-speed media processing for selectively diverting media transported along a conveying path during processing and conveying the diverted media in an opposite divert direction. In accordance with this invention, diverter apparatus 10 can also be used to convey media along the conveying direction when the divert action does not occur.

The conveying path of diverter apparatus 10 extends generally from between pair of rollers 20A and 20B to between pair of rollers 24A and 24B. While it is possible to position diverter apparatus 10 in any suitable location in a high-speed media processing apparatus, it has been found to be particularly advantageous to locate diverter apparatus 10 between a machine for folding sheets of paper and a machine for inserting the folded sheets of paper into envelopes. In such a case, rollers 20A and 20B can therefore be exit rollers for a media folding machine, and rollers 24A and 24B can send media advancing therethrough for further processing in a machine for inserting folded media into envelopes. For ease of explanation, the media item or medium referred to with respect to the description herein of diverter apparatus 10 will be referred to as a sheet of paper although it is specifically contemplated that any suitable medium could be used in association with diverter apparatus 10 for high-speed media processing. It is also envisioned that more than a single medium can be processed in a stacked arrangement by diverter apparatus as is suitable and desirable under the circumstances.

Diverter apparatus 10 comprises at least one rotation member which can be a belt, such as belt 30, or other suitable rotation mechanism on which a plurality of push members, such as push members 40A, 40B and 40C and 40D are secured for passing through a slot defined in tray 70 and engaging and conveying sheets during high-speed processing. Push members 40A–D can be adapted to engage and convey media in the conveying and/or divert directions discussed hereinbelow. As shown, however, the push members are of the type disclosed in a corresponding patent application commonly owned and incorporated by reference herewith, and each of the push members is adapted to convey media in one direction only. For example, push members 40A and 40C as positioned on belt 30 are adapted for conveying media in the divert direction only, and push members 40B and 40D as positioned on belt 30 are adapted for conveying media in the conveying direction only.

At least one motor M is utilized to drive belt 30 and can have a rotatable shaft S extending from the motor and drivably connected to a gear or pulley, such as drive gear 32. Alternatively, motor M can be used to drive another rotation mechanism such as a belt which drives drive gear 32. Motor M can be a closed-loop servomotor or a step motor, and the motor drive electronics (not shown) are preferably programmed for two actions with one of the actions being rotation in a forward direction for conveying sheets in the direction of the conveying path, and the other action being reverse rotation for diverting and conveying sheets in an opposite divert direction. Additionally, it is contemplated according to this invention that more than one motor could be utilized to drive the belt or other rotation mechanism of diverter apparatus 10 as is suitable and apparent to those of skill in the art of high-speed media processing. Other non-drive gears or pulleys, such as gears 36 and 35, can also be used with belt 30 as desired to form the path of belt 30.

A sheet can enter diverter apparatus 20 after passing between rollers 20A and 20B, and the sheet is advanced by O-ring belt 50 over a divert chute shelf 60 and onto tray 70 at a position past brushes 52. In the divert mode described hereinbelow, the sheet can be advanced by O-ring belt 50 to a position against a push member for diverting and conveying the sheet in the divert direction. For example, as illustrated in FIG. 1, sheet S has been advanced to a position on tray 70 against push member 40A where push member 40A engages sheet S and can then divert and convey it in the divert direction. Brushes 52 are positioned at an angle to contact or at least be positioned very proximate to the top of tray 70 so that sheets advanced by O-ring belt 50 in the conveying direction are allowed to pass between brushes 52 and tray 70 while brushes 52 prevent sheets that have passed in such manner thereby from bouncing off of a push member, such as push member 40A, and into divert chute generally designated 62 (described hereinbelow).

In the normal advance mode wherein sheets of paper pass in the conveying direction of the conveying path, belt 30 is rotated by drive gear 32(which is rotated by motor M) so that at least one of the push members thereon will cause sheets in position on tray 70 to be conveyed along the conveying path towards rollers 24A and 24B. In the views shown in FIGS. 1 and 2 of the drawings, belt 30 will therefore be rotated by drive gear 32 in a clockwise manner during the advance mode, and push members 40B and 40D can be used to cause sheets properly positioned on tray 70 to be advanced towards rollers 24A and 24B. It can be readily understood to those of skill in the art of high-speed media processing that belt 30 can rotate clockwise to place push member 40B in a position to engage and convey in the conveying direction a sheet which has been advanced through rollers 20A and 20B and by O-ring belt 50. The sheet is thereby conveyed to rollers 24A and 24B.

Once a sheet reaches rollers 24A and 24B, which are preferably continuously driven, the sheet is quickly advanced therebetween by such rollers as the speed of rollers 24A and 24B is preferably such that the sheet is accelerated out of the way of the push member used to convey the sheet before the push member is again rotated in a downward direction. Belt 30 can continually rotate in the conveying direction until the next push member, such as push member 40D, is moved into position to engage another sheet to be conveyed in the conveying direction. Alternatively, belt 30 can be caused to rotate in the reverse, divert direction as described hereinbelow.

As a primary feature of the present invention, belt 30 can selectively be rotated, as driven by drive gear 32 and motor M, in a divert mode in a reverse, divert direction which is opposite from the direction of the conveying path. In the views shown in FIGS. 1 and 2 of the drawings, belt 30 will therefore rotate in a counter-clockwise manner during the divert mode, and push members 40A and 40C can be utilized to divert and convey sheets properly positioned on tray 70 in the divert direction through brushes 52 and into a divert chute 62 defined by a plurality of walls, such as walls 64 and 66. Although FIGS. 1 and 2 show only walls 64 and 66 of divert chute 62, other walls can of course be utilized as well for divert chute 62, such as, for example, side walls(not shown) connecting walls 64 and 66 as desired.

It can therefore be readily understood to those of skill in the art of high-speed media processing that belt 30 can be rotated counter-clockwise to place push member 40A in a position where it can engage, divert and convey in the divert direction a sheet which has been advanced through rollers 20A and 20B and by O-ring belt 50. Each diverted sheet is thereby conveyed in the divert direction to divert chute 62. Belt 30 can continually rotate in the divert direction until the next push member, such as push member 40C, is moved into position to engage another sheet to be diverted. Alternatively, belt 30 can selectively be caused by drive gear 32 and motor M to rotate in the conveying direction.

Wall 64 of divert chute 62 terminates at an upper end thereof at divert chute shelf 60, and divert chute shelf 60 is preferably spacedly positioned above tray 70 so that diverted sheets pass between tray 70 and divert chute shelf 60 to enter divert chute 62. Divert chute 62 preferably extends vertically below tray 70 and with wall 64 being curved, is adapted to allow and direct diverted sheets to pass therethrough where they can fall by gravity to a collecting bin 68 positioned at an opposite end of divert chute 62 from tray 70. Collecting bin 68 is preferably detachable from or entirely disconnected from divert chute 62 so that diverted sheets can easily be removed from collecting bin 68.

In the preferred embodiment of diverter apparatus 10, both the advance and divert rotation actions of belt 30, as caused rotation of drive gear 32 and motor M, to drive belt 30 consist of movement equal to one-half of the length of belt 30 which, along with the preferred spaced positioning of the push members on belt 30, allow a push member to always be in a position ready to receive the next sheet at the end of either an advance or divert action. As will be apparent to those of skill in the art, the initial position of the push members on belt 30 can be adjusted for different length documents. In a preferred embodiment, the total belt length can be approximately twenty-three (23) inches, and belt 30 can handle sheets as long as approximately six (6) inches and as short as three (3) inches after folding. It has been found that the advance action of diverter apparatus 10 can be completed as fast as approximately 0.150 seconds, and that the divert action can be completed in approximately 0.200 seconds.

It is therefore seen that the present invention provides a novel diverter apparatus and method for high-speed media processing for diverting media from a conveying path and directing and advancing diverted media in an opposite divert direction for ultimate collection. It can also be appreciated that the diverter apparatus and method of the present invention enable a single apparatus to be utilized to convey media in a forward conveying direction as well as to selectively divert media from the conveying direction and advance the diverted media in a reverse, opposite divert direction.

It will be understood that various details of the invention may be changed without departing from the scope of the invention. Furthermore, the foregoing description is for the purpose of illustration only, and not for the purpose of limitation, as the invention is defined by the following, appended claims.

What is claimed is:

1. A diverter apparatus for selectively conveying or diverting single and stacked media from a conveying direction in a media processing apparatus, said diverter apparatus comprising:

(a) a support member which supports said media advanced to and collected on said support member;

(b) a rotation member which conveys said media collected on said support member in a forward conveying direction in a convey mode or selectively conveying said media collected on said support member in a reverse divert mode; and (c) a plurality of push members on said rotation member including a first push member which pushes said media collected on said support member in the forward conveying direction and a second push member which stops said media advanced to and collected on said support member from further advancement in the conveying direction and said second push member also pushes said media collected on said support member in the reverse divert direction.

2. The diverter apparatus of claim 1 wherein said rotation member comprises a belt.

3. The diverter apparatus of claim 1 further comprising a step motor for driving said rotation member.

4. The diverter apparatus of claim 1 further comprising at least one closed-loop servomotor for driving said rotation member.

5. The diverter apparatus of claim 1 further comprising a collecting bin for receiving diverted media.

6. The diverter apparatus of claim 5 further comprising a divert chute for passage of diverted media therethrough to said collecting bin.

7. The diverter apparatus of claim 1 further comprising means for preventing media from moving a predetermined extent in said divert direction while said media is being conveyed in said conveying direction in the conveying mode while allowing media to move in said divert direction in the divert mode.

8. The diverter apparatus of claim 7 wherein said diverter apparatus further comprises a collecting bin for receiving diverted media, and wherein said means for preventing media from moving a predetermined extent in said divert direction is adapted for preventing media from passing to said collecting bin and is adapted for allowing media to move in said conveying direction.

9. The diverter apparatus of claim 7 wherein said means for preventing media from moving a predetermined extent in said divert direction comprises a plurality of angled brushes.

10. A method of diverting single and stacked media from a conveying direction in a media processing apparatus, said method comprising the steps of:

(a) providing a diverter apparatus comprising:

(i) a support member which supports said media advanced to and collected on said support member;

(ii) a rotation member which conveys said media collected on said support member in a forward conveying said direction in a convey mode or selectively conveying said media collected on said support member in a reverse divert direction in a divert mode; and (iii) a plurality of push members on said rotation member including a first push member which pushes said media collected on said support member in the conveying direction and a second push member which stops said media advanced to and collected on said support member from further advancement in the conveying direction and said second push member also pushes said media collected on said support member in the reverse divert direction:

(b) advancing said media in the conveying direction to and collecting said media on said support member;

(c) stopping said media advanced to and collected on said support member from further advancement in the forward conveying direction;

(d) conveying said media collected on said support member in the conveying direction by said rotation member rotating in the conveying direction to cause said first push member to convey said media in the conveying direction; and (e) selectively conveying said media collected on said support member in the reverse divert direction by said rotation member rotating in the reverse divert direction to cause said second push member to convey said media collected on said support member in the reverse divert direction.

11. The method of claim 10 further comprising the step of collecting diverted media.

12. The method of claim 11 wherein collecting said diverted media is accomplished by at least one of said push members conveying said media into a divert chute through which said media passes to a collecting bin.

13. The method of claim 10 wherein said media comprises one or more folded sheets of paper.

* * * * *